US006971276B2

(12) United States Patent
Harris et al.

(10) Patent No.: US 6,971,276 B2
(45) Date of Patent: Dec. 6, 2005

(54) RECOVERY OF PURIFIED VOLATILE METAL SUCH AS LITHIUM FROM MIXED METAL VAPORS

(75) Inventors: Ralph Harris, Westmount (CA); Albert Edward Wraith, Warkworth (GB)

(73) Assignee: McGill University, Montreal (CA)

( * ) Notice: Subject to any disclaimer, the term of this patent is extended or adjusted under 35 U.S.C. 154(b) by 11 days.

(21) Appl. No.: 10/399,553

(22) PCT Filed: Oct. 16, 2001

(86) PCT No.: PCT/CA01/01457

§ 371 (c)(1),
(2), (4) Date: Apr. 24, 2003

(87) PCT Pub. No.: WO02/34954

PCT Pub. Date: May 2, 2002

(65) Prior Publication Data

US 2004/0035249 A1 Feb. 26, 2004

Related U.S. Application Data

(60) Provisional application No. 60/243,415, filed on Oct. 27, 2000.

(51) Int. Cl.[7] ..... C22B 26/12

(52) U.S. Cl. ..... 74/406; 75/588; 75/590; 423/636

(58) Field of Search ..... 75/406, 407, 408, 75/409, 588, 589, 590; 423/636

(56) References Cited

U.S. PATENT DOCUMENTS

| | | | | |
|---|---|---|---|---|
| 3,237,380 | A * | 3/1966 | Barrett | 75/406 |
| 4,456,479 | A | 6/1984 | Harris et al. | |
| 4,738,716 | A | 4/1988 | Roumieu | |
| 4,781,756 | A | 11/1988 | Frianeza-Kullberg et al. | |
| 4,888,052 | A | 12/1989 | Harris et al. | |
| 6,086,653 | A * | 7/2000 | Joo et al. | 75/491 |
| 6,458,182 | B2 * | 10/2002 | Shindo et al. | 75/588 |

OTHER PUBLICATIONS

Patent Abstracts of Japan, vol. 002, No. 034 (C-005), Mar. 8, 1978 & JP 52 133010 A (Japan Atom Energy Re Inst), Nov. 8, 1977 abstract.

Database WPI, Section Ch, Week 198829, Derwent Publications Ltd., London, GB; AN 1988-202028 XP002202520 & JP 63 140096 A (Sumitomo Light Metal Ind. Co.), Jun. 11, 1988, abstract.

Database WPI, Section Ch, Week 198839, Derwent Publications Ltd., London, GB: AN 1988-275980 XP002202251 & JP 63 203729 A (Nippon Kokan KK), Aug. 23, 1988, abstract.

* cited by examiner

*Primary Examiner*—Melvyn Andrews
(74) *Attorney, Agent, or Firm*—Ogilvy Renault LLP

(57) ABSTRACT

The present invention is concerned with a method for extracting selectively a metal from a metal mixture in the gaseous phase. The method comprises heating the metal mixture to vaporize the metal; condensing the metal contaminants present in the vapor; reacting any contaminants remaining in the vapor with a reagent to precipitate the remaining contaminants, and collecting the purified metal.

7 Claims, No Drawings

RECOVERY OF PURIFIED VOLATILE METAL SUCH AS LITHIUM FROM MIXED METAL VAPORS

This is a national stage application of PCT/CA01/01457 under 35 USC 371 filed Oct. 16, 2001, which claims benefit of 60/243,415, filed Oct. 27, 2000.

TECHNICAL FIELD

The present invention is concerned with a method for extracting selectively a volatile metal from a metal mixture in the gaseous phase. The method comprises heating the metal mixture to vaporize the metal; condensing the metal contaminants present in the vapour; reacting any contaminants remaining in the vapour with a reagent to separate the remaining contaminants, and collecting the purified metal.

BACKGROUND ART

There is an increasing demand for metallic high grade lithium for use in electric storage batteries. Lithium is currently extracted from a number of natural resources such as salt brines, by a method that produces lithium chloride that is subsequently electrolyzed, to produce chlorine and lithium metal. U.S. Pat. No. 4,888,052 further teaches the extraction of lithium from the mineral spodumene, $LiAlSi_2O_6$, by reduction of decrepitated spodumene with a molten mixture of aluminum and magnesium, to produce an aluminum-magnesium-silicon alloy containing lithium dissolved therein. The lithium is extracted by distillation at reduced pressure by conventional techniques, such as the one disclosed in U.S. Pat. No. 4,456,479. However, this distillation method causes some of the other metals present in the alloy to be extracted during the distillation, and great care must therefore be taken to prevent contamination of the lithium.

In particular, magnesium, and sodium if present, are extracted from the alloy at the same time as lithium due to their high vapour pressure with respect to the aluminum in the alloy. There is also some contamination from the evaporation of aluminum. The present means of separating the magnesium from the lithium is by selective condensation which relies solely on the differences in vapour pressures of the magnesium and lithium at any particular temperature. The present invention uses this difference as well as the differences in the reactivities of the magnesium and the lithium to effect a separation.

As of today, distillation methods employed for the purification of metals consist in heating the metal or metal mixture, alloyed or not, at atmospheric pressure or under vacuum and selectively condensing each metal. Such method carries important limitations whenever 2 or more metals have neighbouring vapour pressures, because significant contamination can occur. This is a common situation for various alloys or metallic compounds, and therefore it becomes difficult to extract selectively a metal at a degree of purity sufficiently high to be able to sell it commercially. The removal of sodium from lithium is also a great challenge and the present process, combined with conventional vacuum distillation techniques, such as the one disclosed in U.S. Pat. No. 4,456,479, is able to reduce sodium to acceptable levels.

It is believed that there is currently no proven technology for the vapour separation of one metal from another, for example magnesium or aluminum from lithium, in the vapour phase. Distillation towers exist for the purification of base metals such as cadmium and zinc in which the metal recovered is the main component of the alloy and the contaminants are less volatile. However, they are not suitable for the recovery of minor elements from alloys. Also, they do not operate at the pressures required for the recovery of lithium from lithium alloys like Al—Mg—Si—Li alloy or other less volatile metals. In particular, distillation towers operate at near to or slightly greater than atmospheric pressure, have no provision for the selective recovery of both parts of the distillate nor do they have a region that acts as a purifier or cleaner of the vapour.

It would therefore be highly desirable to develop a method for the selective separation of a volatile, reactive metal from a metallic mixture containing metals, alloys or combinations thereof in a manner such that very little contamination, if any, of the volatile metal would take place during the separation, thereby producing high grade metals. A significant advantage of such method would be that materials, metals mixtures or alloys that are otherwise considered of limited value because the metals cannot be separated in a sufficiently high purity by conventional methods, could be recovered profitably. The method could also be used for further purifying volatile, reactive metals that are already refined, but still containing small concentrations of undesirable impurities.

DISCLOSURE OF THE INVENTION

In accordance with the present invention, there is now provided a method for the selective extraction of a volatile metal from a metal mixture, wherein other contaminating metals in the mixture are more reactive than the volatile metal, the method comprising the steps of:

a) heating the metal mixture under reduced pressure until the temperature is sufficiently high to produce a vapour of the volatile metal;
b) optionally condensing the contaminating metals of the volatile metal on a condenser maintained at a temperature preventing condensation thereon of the volatile metal;
c) removing any remaining contaminating metal of the volatile metal from the vapor thereof by contacting the vapor with a reagent to produce and precipitate compounds of the contaminating metals that are physically separate from the volatile metal; and
d) collecting the purified volatile metal.

In a preferred embodiment, spodumene is used as the metal mixture, and lithium is separated from magnesium in the vapour phase, to produce purified lithium. The degree of purity of the volatile metal can be increased simply by repeating the method several times thereon. The reduced pressure during the method is preferably equal to or less than the vapour pressure of the metal mixture.

In the present method, the temperature of the optional condenser in step b) depends on the composition of the vapour with respect to the volatile metal to be separated. A suitable temperature can be easily determined by anyone skilled in the art, and may be higher or lower than the temperature of the metals mixture.

The metal mixture may comprise one or more metals in an elemental form, alloys, or combinations thereof

DETAILED DESCRIPTION OF THE INVENTION AND PREFERRED EMBODIMENTS

The purpose of the present method is to allow the separation of metal vapours, for example magnesium from lithium, with spodumene being preferably used as the starting material, while simultaneously recovering the greater proportion of one metal vapour, and ultimately, all the desired metal in a purified form. The present invention also allows for the collection of metals like magnesium, lithium and the like, as liquids rather than as a solid condensate, resulting in less contamination of the product upon its removal from the process.

It has been found that during the distillation (or volatilization) of a mixture comprising at least one volatile metal, passing the evaporant produced from the molten metals mixture over a condensing surface maintained at a temperature low enough to condense contaminating metals but high enough to suppress condensation of the volatile metal to be separated, produces an upgraded evaporant vapour flow depleted of contaminating metals in the vapour phase. Subsequently, the upgraded evaporant is passed across a reactive substrate such that any remaining contaminating metal reacts with the substrate, and is removed from the upgraded evaporant, to produce a purified evaporant suitable for the recovery of the volatile metal in the form of a liquid on a collector by condensation in a conventional manner. In a preferred embodiment, the metal mixture comprises molten aluminum, magnesium silicon and lithium, the contaminating metal to be removed is magnesium, and the purified metal is lithium. The method can be used for the separation of various other metals in the vapour phase, for example calcium from magnesium, sodium from strontium, etc.

The term "volatile metal" refers to the volatility of the metal, which is relative to the alloy from which the metal is volatilizing or relative to atmospheric pressure. Each metal/alloy pair possesses a volatility coefficient, the magnitude of which indicates the degree of volatility of the metal. For example, a particular minor element with a volatility coefficient greater than one (1) in a molten alloy comprising several species is defined as volatile with respect to the melt from which it is evaporating. Volatility coefficients have been published for aluminium alloys, and because magnesium and lithium are generally present in such alloys, it is therefore known that magnesium and lithium have a respective volatility coefficient of $1.1\times10^7$ and $3.54\times10^6$. When the bulk of the alloy species is evaporating, it would be considered volatile if a red heat, the vapour pressure of the evaporating species exceeds 10,000 pascals.

Oxidation is a preferred method for the removal of any remaining contaminating metal (step c) of the method). Such oxidation can be performed with various oxidants such as a metal/metal oxide system. A critical aspect of the present method is that there is a specific range of oxygen pressures that is dependent on the composition of the mixed vapour for which the oxygen will react and hence remove all reactive vapours from the flow but the desired metal vapor. If the oxygen pressure is too high, the volatile metal to be collected will be oxidized and precipitated, while if the oxygen pressure is too low, the contaminants will not be oxidized, and therefore not removed. The required oxygen pressure can be created, for example, by heating a metal/metal oxide system to a point where it exhibits the necessary oxygen pressure and does not act as a condenser for the vapours, i.e., the temperature of metal/metal oxide system is at least that of the volatilization temperature of the volatile metal to be recovered. A titanium/titanium oxide system represents a preferred embodiment for this purpose. To obtain a suitable oxygen pressure, the temperature of the $Ti/TiO_2$ has to be carefully adjusted for example, between 774 and 822° C. to produce an acceptable degree of purification in a particular operation, since the oxygen pressure derives from the equilibrium $Ti+O_2 \leftrightarrows TiO_2$, which is temperature dependant. Thus, supposing that oxygen is used as the reactant for the contaminating metals, then if another metal, G, is used, the temperature of the equilibrium $x\ G+y\ O_2 \leftrightarrows G_xO_{2y}$ will determine the oxygen pressure. If another reactive substance, R, like chlorine, for example is used, then the temperature of equilibrium $x\ G+y\ R \leftrightarrows G_xR_y$ would determine the R pressure and hence the degree of purification. It has also been discovered that the relationship between the temperature of the system and the degree of impurity removal is counter-intuitive, the more removal sought, the lower the temperature of operation. However, there is an absolute lower limit for the temperature of operation and that is the temperature when the metal is oxidized. The temperature can be calculated from the Gibbs Energy for the equilibrium: $G_xR_y+(wy/z)\ M_{(g)}=(y/z)\ M_wR_z+x\ G$ where the pressure of M is specified or set by the evaporation conditions.

EXAMPLE

The following example is provided to illustrate preferred embodiments of the present invention, and shall not be construed as limiting its scope.

Example 1

An alloy containing 8 wt. % Mg, 5 wt. % Si, 0.1 wt. % Li, and the balance Al, was heated at a temperature of 1100° C. under a pressure of 10 Pa. The evaporant that issued from the melt was passed through a condenser at a temperature of 600° C. onto which portion of the magnesium in the evaporant is condensed. The remaining evaporant was passed across a partially oxidized titanium metal mesh held at a temperature of 800° C. whereby the $TiO_2$ on the mesh oxidizes the remaining Mg in the evaporant to produce an evaporant with a Li/Mg molar ratio of 65 to 1 and solid Ti and MgO attached to the mesh. The so-purified evaporant was then condensed as a liquid on a collector at a temperature of 300° C. The rate at which lithium condensed on the collector was 8.1 kg/hr.

While the invention has been described in connection with specific embodiments thereof, it will be understood that it is capable of further modifications, and this application is intended to cover any variations, uses or adaptations of the invention following, in general, the principles of the invention, and including such departures from the present description as come within known or customary practice within the art to which the invention pertains, and as may be applied to the essential features hereinbefore set forth, and as follows in the scope of the appended claims.

What is claimed is:

1. A method for the selective extraction of a desired first volatile metal from a molten metal mixture, comprising at least said first metal and a second volatile metal, wherein the vapour of said second volatile metal in the mixture is more reactive than the vapour of the first volatile metal, the method comprising the steps of:

a) heating the molten metal mixture under reduced pressure until its temperature is sufficiently high to produce a mixed vapour of the first and second volatile metals;

b) removing the second volatile metal from the mixed vapour by contacting the mixed vapour with a reagent to produce and precipitate a compound of the second metal from the mixed vapour so as to leave a resultant vapour consisting essentially of the first metal, wherein the reagent generates an oxygen pressure to oxidize said second volatile metal; and c) collecting the first metal from said resultant vapour as purified first metal.

2. A method as claimed in claim 1, wherein said first metal is lithium and said second metal is magnesium.

3. A method according to claim 2, wherein said molten metal mixture comprises an alloy of aluminum, magnesium, silicon and lithium derived from spodumene.

4. A method as claimed in claim 1, wherein the reduced pressure in step a) is less than the vapour pressure of said metal mixture.

5. A method as claimed in claim 2, wherein said reagent comprises titanium oxide.

6. A method as claimed in claim 5, wherein said reagent comprises a mesh of partially oxidized titanium metal and said mixed vapour is passed across said mesh such that titanium oxide of the mesh oxidizes magnesium in the mixed vapour to produce solid magnesium oxide on said mesh and said resultant vapour of lithium.

7. A method as claimed in claim 1, wherein prior to step b) a portion of said second metal is condensed from said mixed vapour on a first condenser maintained at a temperature effective for condensation of said second metal from said mixed vapour while being ineffective for condensing said first metal from said mixed vapour.

* * * * *